US006146499A

United States Patent [19]

Lin et al.

[11] Patent Number: 6,146,499

[45] Date of Patent: Nov. 14, 2000

[54] METHOD FOR INCREASING CROSS MACHINE DIRECTION STRETCHABILITY

[75] Inventors: Philip S. Lin, Oshkosh; Michael J. Rekoske, Nina, both of Wis.

[73] Assignee: Kimberly-Clark Worldwide, Inc., Neenah, Wis.

[21] Appl. No.: 08/996,180

[22] Filed: Dec. 22, 1997

[51] Int. Cl.[7] ..... D21F 11/00

[52] U.S. Cl. ..... 162/197; 162/111; 162/109; 162/113; 162/125

[58] Field of Search ..... 162/109, 113, 162/111, 112, 117, 123, 125, 129, 130, 141, 147, 9, 197, 270, 271, 407

[56] References Cited

U.S. PATENT DOCUMENTS

| | | | |
|---|---|---|---|
| Re. 25,335 | 2/1963 | Hamilton | 162/113 |
| 1,196,888 | 9/1916 | Scherf | 162/196 |
| 1,582,838 | 4/1926 | Lorenz | 162/113 |
| 1,582,842 | 4/1926 | Lorenz | 162/113 |
| 1,676,759 | 7/1928 | Widmer | 162/113 |
| 1,823,877 | 9/1931 | Cannard | 162/113 |
| 2,008,182 | 7/1935 | Kemp | 249/196 |
| 2,996,425 | 8/1961 | Hamilton | 162/113 |
| 3,104,197 | 9/1963 | Back et al. | 162/113 |
| 3,523,865 | 8/1970 | Ihrman | 162/113 X |
| 3,687,797 | 8/1972 | Wideman | 161/129 |
| 3,802,952 | 4/1974 | Gurin et al. | 161/164 |
| 4,523,969 | 6/1985 | Spencer | 156/161 |
| 4,642,151 | 2/1987 | Coenen | 156/164 |
| 4,735,673 | 4/1988 | Piron | 156/496 |
| 4,849,278 | 7/1989 | Stokes | 428/153 |
| 4,917,695 | 4/1990 | Villez | 604/370 |
| 4,943,340 | 7/1990 | Ujimoto et al. | 156/496 |
| 5,259,902 | 11/1993 | Muckenfuhs | 156/164 |
| 5,376,198 | 12/1994 | Fahrenkrug et al. | 156/164 |
| 5,386,665 | 2/1995 | Heim | 451/5 |
| 5,393,384 | 2/1995 | Steiner et al. | 162/359.1 |
| 5,393,599 | 2/1995 | Quantrille et al. | 428/284 |
| 5,407,507 | 4/1995 | Ball | 156/163 |
| 5,429,686 | 7/1995 | Chiu et al. . | |
| 5,607,551 | 3/1997 | Farrington, Jr. et al. | 162/109 |
| 5,626,571 | 5/1997 | Young et al. . | |
| 5,672,248 | 9/1997 | Wendt et al. | 162/109 |
| 5,746,887 | 5/1998 | Wendt et al. | 162/109 |
| 5,817,213 | 10/1998 | Ostermayer et al. . | |

FOREIGN PATENT DOCUMENTS

| | | |
|---|---|---|
| 0 184 261 A2 | 6/1986 | European Pat. Off. . |
| 0 672 516 A2 | 9/1995 | European Pat. Off. . |
| WO 95/08313 | 3/1995 | WIPO . |

OTHER PUBLICATIONS

Article entitled "Forming handsheets for physical tests of pulp", T 205 sp–95.

*Primary Examiner*—Stanley S. Silverman
*Assistant Examiner*—Jose' S. Fortuna
*Attorney, Agent, or Firm*—Brinks Hofer Gilson & Lione

[57] ABSTRACT

A method and product is disclosed to obtain sheets with increased cross-machine stretch. The method involves the use of a cross-machine stretchable fabric upon which a wet web of paper is placed. The method results in a product having increased cross-machine stretch.

5 Claims, 3 Drawing Sheets

METHOD FOR INCREASING CROSS MACHINE DIRECTION STRETCHABILITY

FIELD OF THE INVENTION

This invention relates to the art of paper making and particularly to a paper sheet having an increased cross-machine stretch and the methods to make such a sheet.

BACKGROUND OF THE INVENTION

The cross-machine direction (CD) stretch of a sheet of paper is an important characteristic or property. Depending on the application to which the paper sheet is put, this property may be of significant importance. Similarly, this property will have a significant effect on the handelability of the sheet during converting operations, and thus, could be of significant importance to such operations. Tissue products, such as facial and bath tissue and towel products are types of paper in which CD stretch is an important characteristic. Thus, it may be desirable to increase the amount of CD stretch over that which is obtained by convention methods and found in convention sheets. For example a creped two layer tissue may have a CD stretch of 4–5%. These levels of CD stretch have been increased in through air dried uncreped tissues, such as those disclosed in commonly assigned U.S. Pat. No. 5,607,551 to about 14% for the base sheet.

SUMMARY OF THE INVENTION

The present invention offers an improvement in paper-making methods and products, by providing a paper sheet and a method to obtain a paper sheet, with improved CD stretch. Thus, by way of example, paper products such as tissue, towel, plain paper, label paper, bag paper, median, liner, and cement bag may benefit from this invention. A particularly useful example of one such product of the present invention would be a stretchable label having a high degree of CD stretch for use on a squeezable package, such as a catsup bottle. The method involves using a paper making fabric or felt that is stretchable in the CD direction to impart stretch to a moist web of paper making fibers in the CD direction prior to the fibers being completely bonded or fixed to one another. This method results in tissues that have an increased CD stretch, which may be greater than about 10%, or greater than about 12%, or greater than about 15%, or even greater. The increase in CD stretch provides a further benefit by reducing the tendency of a sheet to tear in the machine direction.

Thus, in one embodiment of the invention there is provided a creped paper sheet comprising one layer of paper making fibers and having a basis weight form about 5 lbs/2880 $ft^2$ to 120 lbs/2880 $ft^2$, a caliper from about 0.004" to 0.100" and having a cross-machine stretch greater than 10%.

In another embodiment of the invention there is provided a soft tissue product comprising one or more tissue plies and having a Bulk of about 9 cubic centimeters per gram or greater and a MD Max Slope of about 10 or less and a cross-machine direction stretch of greater than about 15%, 18%, 20% or even greater.

In yet another embodiment of the invention there is provided a tissue paper sheet comprising one layer of paper making fibers and having a basis weight from about 5 lbs/2880 $ft^2$ to 28 lbs/2880 $ft^2$, a caliper from about 0.004" to 0.040" and a cross-machine stretch greater than about 15%.

In a further embodiment of the invention there is provided a paper sheet having at least on layer comprising paper making fibers and having a cross-machine direction stretch equal to or greater than its machine direction stretch.

In alternative embodiments of the invention there is provided a method of making a paper sheet comprising the acts of: forming an aqueous solution comprising paper making fibers; dewatering the aqueous solution to form a wet web; and, mechanically compressing the wet web in the cross-machine direction. A method of making a tissue product comprising the acts of: forming an aqueous solution comprising paper making fibers; impinging the aqueous solution on a forming fabric; dewatering the aqueous solution to form a wet web having a moisture content from about 20% to about 40% solids by weight; stretching a cross-machine direction stretchable fabric in the cross-machine direction; placing the wet web on the stretched cross-machine direction stretchable fabric; relaxing the cross-machine stretchable fabric and the wet web in the cross-machine direction; and, drying the wet web to form a tissue sheet. A method of making a towel product comprising the acts of: forming an aqueous solution comprising paper making fibers; impinging the aqueous solution on a forming fabric; dewatering the aqueous solution to form a wet web having a moisture content of less than about 50% solids by weight, decreasing the width of the wet web in the cross-machine direction; and, finally drying the wet web to form a tissue sheet.

To aid in understanding the invention one is directed towards the drawings and the detailed description of the presently preferred embodiments of the invention.

DETAILED DESCRIPTION OF PRESENTLY PREFERRED EMBODIMENTS OF THE INVENTION

Figure 1:
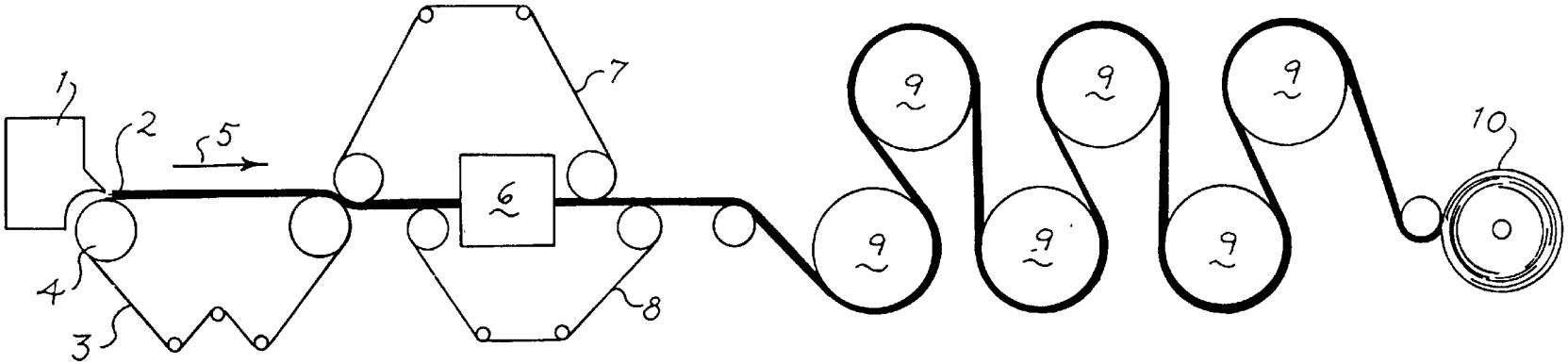
FIGS. 1 and 1A are schematic drawings illustrating a paper making machine and process flow.

Referring to FIG. 1 there is shown a schematic illustrating a paper machine and process flow. For simplicity, the various tensioning rolls schematically used to define several fabric runs are shown but not numbered. It is appreciated that variations from the apparatus and process illustrated can be made without departing from the scope and spirit of this invention. This type of paper machine may be used to make any type of paper or paper products from lightweight tissues to writing paper to label papers to heavier weight papers such as median, liner boards and cement bags.

A slurry of paper making fibers, that may be referred to as a stock solution or stock, is pumped by a fan pump, not shown, to a head box 1. The head box may be a single or multi-layer type. Upon exiting the slice, the slurry is placed on a forming fabric, or wire, 3 at or near the breast roll 4, where water is then removed from the slurry to from a wet web of paper making fibers 2. The wet web 2 and the forming fabric 3 are moving together in the direction of arrow 5. The wet web 2 is then transferred to CD stretchable fabric 7 and CD stretchable fabric 8, where it is stretched in the CD direction by stretching apparatus 6. The wet web should be below about 40% solids when stretched in the CD direction. After being stretched it is transferred to a dryer section, for example, can dryers 9, where it is dried to its final dryness and then wound on reel 10. Any other type of drying apparatus may be employed. A wet press may also be used and may be placed either before or after the stretching apparatus 6. Also, one of the CD stretching fabrics may be eliminated.

Figure 1A:
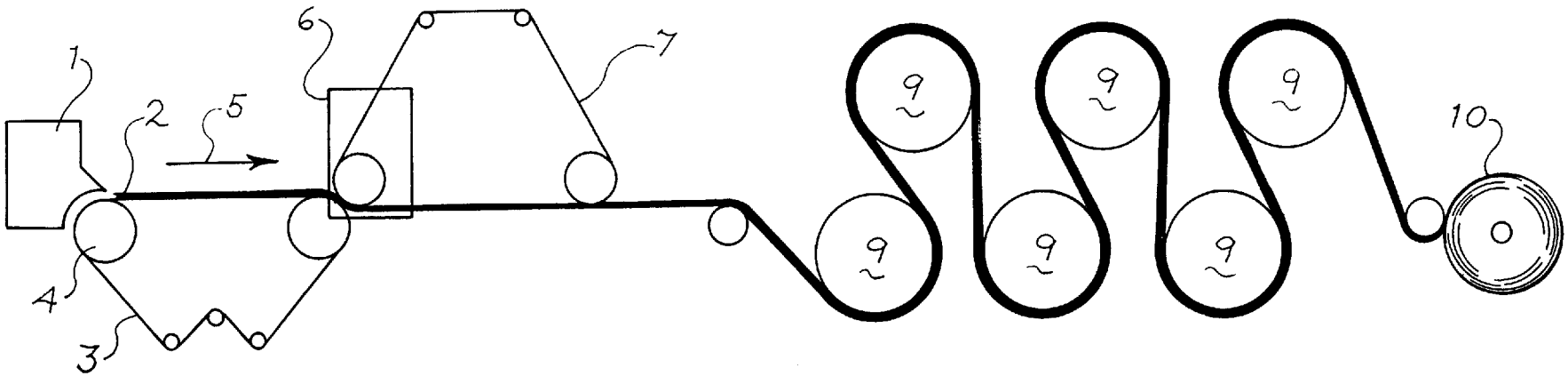

FIG. 1A illustrates an alternative and preferred configuration of the process and machine shown in FIG. 1. In FIG. 1A the CD stretching apparatus is located at, or before the point where the wet web is transferred to the CD stretchable fabric. Thus, the fabric is stretched in the CD direction prior to the wet web being placed on it. Once the wet web is placed on the stretched CD-stretchable fabric, the fabric is relaxed in the CD direction thus compressing the wet web in the CD direction.

The stretching apparatus may employ any known technique for increasing the width of a moving web or sheet, i.e., stretching the fabric in the direction that is transverse to the direction of movement. By way of example, such apparatus would include a tinterframe, a mount hope roll, or a bowed roll. The stretching apparatus is preferably positioned just before or at the point of transfer for the wet web. The CD stretchable fabric may be woven from PET or PEEK filaments in the machine direction and elastic filaments, such as Lycra® in the cross-machine direction. The stretching apparatus stretches the CD stretchable fabric in the CD direction prior to the wet web being placed on it. The fabric may be stretched from about 1% to about 15% or greater, and preferably may be stretched from about 5% to about 10%. The wet web is placed on the CD stretchable fabric while the fabric is in the stretched state. The stretched fabric is then, preferably, quickly relaxed, causing the fabric and the wet web along with it to contract in the CD direction. Greater or lesser amounts of stretch could be employed depending upon the conditions present when stretching occurs, such as the type of paper, machine speed, and wet web moisture level, and the results sought to be obtained from the process. The wet web when compressed in the CD direction should be at about 20% to 40% solids. The wet web, however, may be at 50% solids or even greater depending on the type of paper and furnish being used. Additionally, water removal devices such as suction boxes or blow through dryers may be used at or near the stretching apparatus to more closely regulate and control the moisture of the wet web before during and after the actual stretching operation and the transfer of the web.

Figure 2:
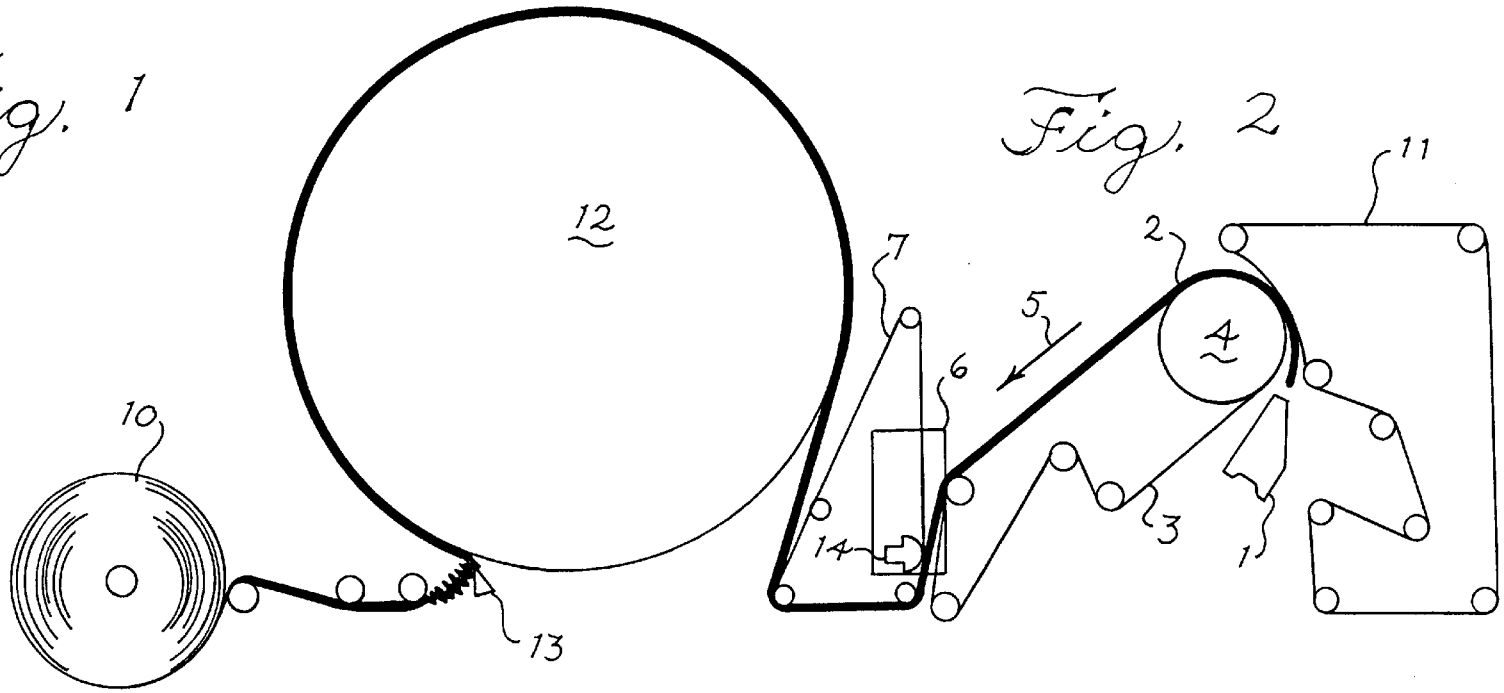
FIG. 2 is a schematic drawing illustrating a paper making machine and process flow having a Yankee drier.

Referring now to FIG. 2, in which is shown a schematic illustrating a twin wire paper machine having a Yankee dryer 12. For simplicity, the various tensioning rolls schematically used to define several fabric runs are shown but not numbered. It is appreciated that variations from the apparatus and process illustrated can be made without departing from the scope and spirit of this invention. This type of paper machine is particularly useful to make facial tissue, bath tissue, and towel. A stock solution is pumped by a fan pump, not shown, to a head box 1. The head box may be a single layer or multi-layer headbox. Upon exiting the slice, the slurry is placed or injected between forming fabrics 3 and 11 at about the breast roll 4, where water is then removed from the slurry to from a wet web of paper making fibers 2. The wet web 2 and the forming fabric 3 are moving together in the direction of arrow 5.

The stretchable fabric 7 is then stretched in the CD direction by stretching apparatus 6. The wet web 2 is then transferred to the stretched CD stretchable fabric 7. This transfer may be further assisted by any known transfer apparatus. By way of example, the transfer apparatus may be a vacuum assist transfer shoe 14. The transfer apparatus serves to draw the wet web into the stretchable fabric 7, so that it can be better held by the stretched fabric. A transfer fabric, or possibly an open draw, may be employed between the forming fabric 3 and the CD stretchable fabric 7 to allow the wet web to be on the top as opposed to the bottom of the stretchable fabric (as shown in FIG. 2) during the stretching operation. After the transfer to the CD stretchable fabric, the fabric is allowed to relax in the CD direction, compressing or contracting the wet web in the CD direction.

The wet web should preferably be below about 40% solids when compressed in the CD direction and preferably for tissue type products be from about 25% to about 30% solids. The sheet is then transferred to a Yankee dryer 12, where it is dried. The sheet is then creped from the Yankee dryer 12 by doctor blade 13 and wound on reel 10. Although for simplicity in the illustration an open draw is shown between the CD stretchable fabric and the Yankee dryer, a transfer fabric could be used at that point if necessary.

Figure 3:
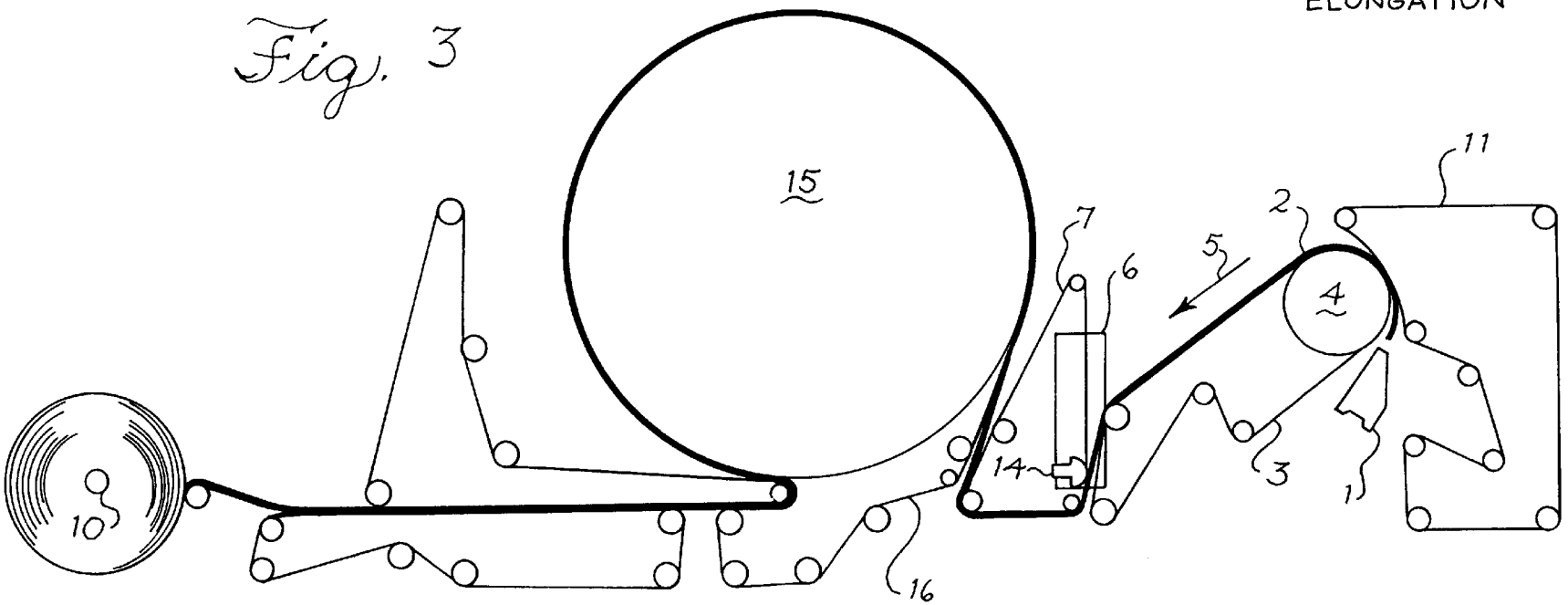
FIG. 3 is a schematic drawing illustrating a paper making machine and process flow for making uncreped through air dried sheets.

Referring now to FIG. 3 in which is shown a schematic illustrating a twin wire paper machine having a through air dryer 15. For simplicity, the various tensioning rolls schematically used to define several fabric runs are shown but not numbered. It is appreciated that variations from the apparatus and method illustrated can be made without departing from the scope and spirit of this invention, such as the use of additional transfer fabric, or open draws may be used. This type of paper machine is particularly useful to make tissues like those disclosed in U.S. Pat. No. 5,607,551, the disclosure of which is incorporated herein by reference.

A stock solution is pumped by a fan pump, not shown, to a head box 1. The head box may be a single layer or multi-layer headbox. Upon exiting the slice, the slurry is injected between forming fabrics 3 and 11 at about the breast roll 4, where water is then removed from the slurry to form a wet web of paper making fibers 2. The wet web 2 and the forming fabric 3 are moving together in the direction of arrow 5.

The stretchable fabric 7 is stretched in the CD direction by stretching apparatus 6. The wet web 2 is then transferred from the forming fabric 3 to the stretched CD stretchable fabric 7 traveling at a slower speed than the forming fabric in order to impart increased stretch to the web. This transfer is carried out with the assistance of a vacuum shoe 14 and a fixed gap or space between the forming fabric and the CD stretchable fabric. The CD stretchable fabric is then relaxed in the CD direction.

It is preferable that the wet web should be below about 50% solids when compressed in the CD direction and more preferably for tissue type products be from about 25% to about 30% solids when compressed. The wet web is transferred to a through drier fabric 16, which carries the web around the through air dryer 15 where additional water is removed. The sheet is then wound on reel 10.

In the embodiment shown in FIG. 3, the CD stretchable fabric serves the dual purposes of enhancing both machine direction stretch, by the speed differential between the two fabrics, and cross-machine stretch by the CD stretching. It is contemplated that in a variation of the process shown in FIG. 3, these purposes could be meet by different fabrics.

In general, the placement of fabric runs and apparatus of the processes and machines illustrated in the figures may be changed to meet the unique requirements of a particular paper mill, machine or process without departing from the spirit of the invention. This is particularly so, for the retrofitting of an existing paper machine to practice the present invention.

The converting operation of taking the base sheet from the reel to the finished paper sheet or product frequently reduces the CD stretch of the finished product when compared to the base sheet. Such converting operations may include, by way of example, winding, rewinding, calendaring, plying, folding, trimming, cutting, printing, embossing, or boxing. Thus, the increased CD stretch obtained by the present invention provides for finished paper products that have CD stretches that were previously only attainable in a base sheet. By way of example, finished tissue products with CD stretch greater than about 4%, or greater than about 5%, or greater than about 7%, or greater than about 9% or even greater may be obtained.

Figure 4:
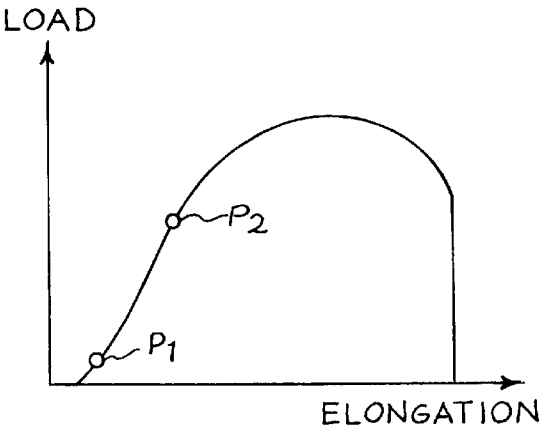
FIG. 4 is a generalized plot of a load/elongation curve for tissue, illustrating the determination of MD Max Slope.

The MD Max Slope is the maximum slope of the machine direction load/elongation curve for tissue. The units for the MD Max Slope are kilograms per 3 inches (7.62 centimeters). FIG. 4 is a generalized load/elongation curve for a tissue sheet, illustrating the determination of the MD Max Slope. As shown, two points P1 and P2, the distance between which is exaggerated for purposes of illustration, are selected that lie along the load/elongation curve. The tensile tester is programmed (GAP [General Applications Program], version 2.5, Systems Integration Technology Inc., Stoughton, Mass.; a division of MTS Systems Corporation, Research Triangle Park, N.C.) such that it calculates a linear regression for the points that are sampled from P1 to P2. This calculation is done repeatedly over the curve by adjusting the points P1 and P2 in a regular fashion along the curve (hereinafter described). The highest value of these calculations is the Max Slope and, when performed on the machine direction of the specimen, is called the MD Max Slope.

The tensile tester program should be set up such that five hundred points such as P1 and P2 are taken over a two and one-half inch (63.5 mm) span of elongation. This provides a sufficient number of points to exceed essentially any practical elongation of the specimen. With a ten inch per minute (254 mm/min) crosshead speed, this translates into a point every 0.030 seconds. The program calculates slopes among these points by setting the $10^{th}$ point as the initial point (for example P1), counting thirty points to the $40^{th}$ point (for example, P2) and performing a linear regression on those thirty points. It stores the slope from this regression in an array. The program then counts up ten points to the $20^{th}$ point (which becomes P1) and repeats the procedure again (counting thirty points to what would be the $50^{th}$ point (which becomes P2), calculating that slope and also storing it in the array). This process continues for the entire elongation of the sheet. The Max Slope is then chosen as the highest value from this array. The units of Max Slope are kg per three-inch specimen width. (Strain is, of course, dimensionless since the length of elongation is divided by the length of the jaw span. This calculation is taken into account by the testing machine program).

While the invention has been described in connection with certain presently preferred embodiments, those skilled in the art will recognize modifications to structures, arrangements, portions, elements, materials and components which can be used in the practice of this invention without departing from the principles of this invention.

We claim:

1. A method of making a tissue product comprising the acts of:

(a) forming an aqueous solution comprising paper making fibers;

(b) impinging the aqueous solution on a forming fabric;

(c) dewatering the aqueous solution to form a wet web having a moisture content from about 20% to about 50% solids by weight;

(d) stretching a cross-machine direction stretchable fabric in the cross-machine direction;

(e) placing the wet web on the stretched cross-machine direction stretchable fabric;

(f) relaxing the cross-machine stretchable fabric in the cross-machine direction; and, (g) drying the wet web to form a tissue sheet.

2. The method of claim 1 in which the cross-machine direction stretchable fabric is stretched at least about 5%.

3. The method of claim 1 in which the cross-machine direction stretchable fabric is stretched at least about 10%.

4. The method of claim 1 in which the cross-machine direction stretchable fabric is stretched at least about 15%.

5. The method of claims 1, 2, 3, or 4 in which the tissue sheet is uncreped.

* * * * *